US009222062B2

(12) United States Patent
Johnson et al.

(10) Patent No.: US 9,222,062 B2
(45) Date of Patent: Dec. 29, 2015

(54) TREATMENT OF HARD SURFACES

(71) Applicant: CRODA INTERNATIONAL PLC, Yorkshire (GB)

(72) Inventors: Stephen Dominic Johnson, Yorkshire (GB); Simon Paul Flavin, Yorkshire (GB); Peter Michael Murphy, Yorkshire (GB); Mahzad Goodwin, Yorkshire (GB)

(73) Assignee: CRODA INTERNATIONAL PLC, East Yorkshire (GB)

( * ) Notice: Subject to any disclaimer, the term of this patent is extended or adjusted under 35 U.S.C. 154(b) by 0 days.

(21) Appl. No.: 14/349,525

(22) PCT Filed: Sep. 26, 2012

(86) PCT No.: PCT/GB2012/052390

§ 371 (c)(1),
(2) Date: Apr. 3, 2014

(87) PCT Pub. No.: WO2013/050743

PCT Pub. Date: Apr. 11, 2013

(65) Prior Publication Data

US 2014/0249070 A1 Sep. 4, 2014

(30) Foreign Application Priority Data

Oct. 6, 2011 (GB) ..... 1117252.5

(51) Int. Cl.

| | |
|---|---|
| ***C11D 1/04*** | (2006.01) |
| ***C11D 1/10*** | (2006.01) |
| ***C11D 1/32*** | (2006.01) |

(Continued)

(52) U.S. Cl.
CPC ..... *C11D 7/3254* (2013.01); *C11D 1/10* (2013.01)

(58) Field of Classification Search
CPC ..... C11D 1/04; C11D 1/10; C11D 1/32; C11D 1/37; B08B 3/04
USPC ..... 510/199, 238, 240, 264, 437, 488, 490, 510/491, 499; 134/25.2, 25.3, 39, 42
See application file for complete search history.

(56) References Cited

U.S. PATENT DOCUMENTS

| | | | |
|---|---|---|---|
| 4,789,495 | A | 12/1988 | Cahall et al. |
| 6,703,358 | B1 | 3/2004 | Aubay et al. |

FOREIGN PATENT DOCUMENTS

| | | |
|---|---|---|
| DE | 10234257 | 2/2004 |
| DE | 10301838 | 7/2004 |

(Continued)

OTHER PUBLICATIONS

Michael Richards, EPO Authorized Officer, International Search Report of PCT/GB2012/052390, Issued Nov. 15, 2012.

(Continued)

*Primary Examiner* — Brian P Mruk
(74) *Attorney, Agent, or Firm* — RatnerPrestia

(57) ABSTRACT

A cleaning composition comprising at least one fatty acid of a sarcosine, and at least one fatty acid of an amino acid, and/or salts thereof. There is also provided an end-use cleaning formulation comprising said cleaning composition having been diluted to 0.2 wt. % to 10 wt. %, and a method of treating a hard surface comprising applying the cleaning composition or the cleaning formulation. The cleaning composition or cleaning formulation are suitable for use in providing soil resistance to a hard surface.

23 Claims, 2 Drawing Sheets

(51) Int. Cl.

| | |
|---|---|
| ***C11D 1/37*** | (2006.01) |
| ***B08B 3/04*** | (2006.01) |
| ***C11D 7/32*** | (2006.01) |

(56) References Cited

FOREIGN PATENT DOCUMENTS

| | | | | |
|---|---|---|---|---|
| EP | 0 427 210 | | 5/1991 | |
| EP | 1 114 640 | | 7/2001 | |
| EP | 2196186 | | 6/2010 | |
| WO | WO 95/33043 | | 12/1995 | |
| WO | WO 98/17765 | | 4/1998 | |
| WO | WO 2010/069500 | * | 6/2010 | ..... A61K 8/44 |
| WO | WO 2011/051646 | | 5/2011 | |

OTHER PUBLICATIONS

European Communication pursuant to Article 94(3) EPC mailed May 26, 2015 for European Application No. 12770199.3.

* cited by examiner

TREATMENT OF HARD SURFACES

CROSS REFERENCE TO RELATED APPLICATIONS

This application is the U.S. National Phase application of PCT International Application No. PCT/GB2012/052390, filed Sep. 26, 2012, and claims priority of British Patent Application No. 1117252.5, filed Oct. 10, 2011, the disclosures of which are incorporated herein by reference in their entireties for all purposes.

FIELD OF THE INVENTION

The present invention relates to combinations of sarcosine fatty acids and amino acid fatty acids, and in particular, use of said combinations in the treatment of hard surfaces and to methods of treating hard surfaces to provide soil resistance.

BACKGROUND OF THE INVENTION

It is common experience that limescale or similar soils can be difficult to remove from hard surfaces. In comparison, hydrophilic soils are usually easier to remove with aqueous wash systems. It is therefore particularly useful to treat hard surfaces to improve their resistance to said soils. A further benefit from improving the soil resistance of hard surfaces is that it may reduce the tendency to form water tide marks and/or the tendency to leave streaks especially after rinsing.

An improvement in the soil repellency of hard surfaces is important in that it reduces the tendency of soil material to adhere to the surfaces, thereby slowing the rate or reducing the extent of soiling. Additionally, the improved soil repellency can make it easier to remove the soil when cleaning the surface by reducing the level of mechanical effort required.

Previous attempts to provide soil resistance include the use of formulations including copolymers of acrylic esters/amides carrying quaternium, particularly diquaternium, substituents for example as described in U.S. Pat. No. 6,703,358. Other hard surface treatments, in particular for oily soils, are described in WO 2011/051646 which discloses use of polymeric compounds to treat surfaces.

The present invention therefore seeks to provide a composition which may provide soil resistance for hard surfaces, and in particular which provides improved soil resistance to a hard surface to which it is applied in comparison with an un-treated surface. The present invention further seeks to provide a method of treating a hard surface with said composition having said soil resistance properties.

SUMMARY OF THE INVENTION

According to a first aspect of the present invention there is provided a cleaning composition comprising at least one fatty acid of a sarcosine, and at least one fatty acid of an amino acid, and/or salts thereof.

In particular, the cleaning composition is suitable for use in providing soil resistance to a hard surface.

According to a second aspect of the present invention there is provided a method of treating a hard surface which comprises applying to the surface a cleaning composition, said composition comprising at least one fatty acid of a sarcosine, and at least one at least one fatty acid of an amino acid, and/or salts thereof.

In particular, the method of the second aspect comprises improving the soil resistance of the hard surface to which it is applied.

DETAILED DESCRIPTION OF THE INVENTION

Figure 1:
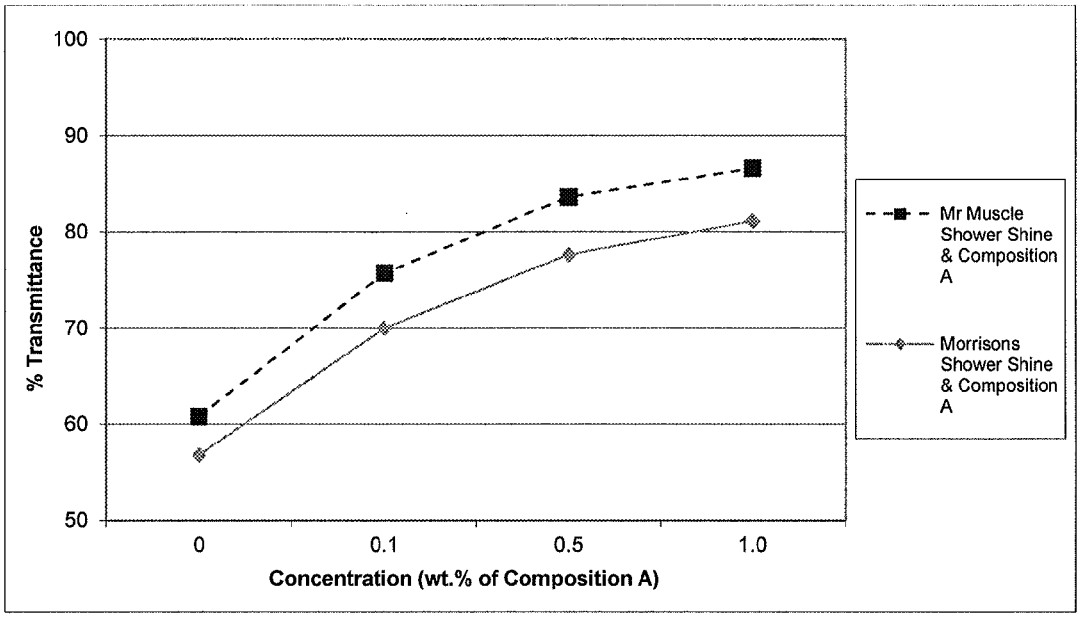
FIG. 1 shows a graph of the limescale repellency results on glass slides.

Surprisingly, it has been found that the combination of fatty acid of a sarcosine and fatty acid of an amino acid provides a cleaning composition which, when applied to a hard surface, enhances both soil repellency and soil release properties. The composition has been found to give good resistance to the deposition of limescale, and/or tide marks from insoluble soap salts, and/or limescale and to streaking from, rinsing water. It has also been found that the combination of the present application can provide soil repellency and release when added to end-use cleaning formulations with a wide pH range, and in particular for those with a pH over 6.

Without wishing to be bound by theory, it has been found that the benefits of the invention may be conferred by the cleaning composition providing a relatively hydrophilic coating which imparts or improves soil repellency to the surface to which it is applied.

It will be understood that use of the term "soil resistance" as used in the present application should be understood to refer to both soil repellency and/or soil release properties. Therefore, when describing the invention of the present application as having or improving soil resistance, this should be understood as the invention providing or imparting improved soil repellence to prevent build up of soils on a surface, and/or soil release properties to surfaces to facilitate subsequent cleaning. In particular, the present invention provides soil repellency to a hard surface.

It will be understood that use of the term "hard surface(s)" as used in the present application should be understood as referring to solid surfaces, particularly but not exclusively to non-porous surfaces such as those of metals, ceramics, glass, wood, and plastics, particularly laminated plastics, all including painted, varnished or sealed surfaces. This should be contrasted with, and would not include, other surfaces, particularly soft and absorbent surfaces such as textiles (cleaned in laundry cleaning) and skin (as in cosmetics, more particularly cosmetic removers).

Examples of hard surfaces include: walls, floors, windows, mirrors, doors, tiles and tiled areas, work surfaces, including cutting and chopping boards, domestic fittings e.g. shelves and cupboards, washing and sanitary fixings e.g. sinks, wash basins, baths, showers and WCs, domestic appliances e.g. stoves, ovens, including microwave ovens, washing machines and dryers, dishwashers, refrigerators, freezers and chillers, food preparation machines e.g. mixers, blenders and food processors, in both domestic and institutional and industrial environments, including in hospitals, medical laboratories and medical treatment environments.

In the context of this invention "soil resistance" is imparting improved soil repellency and/or soil release properties to surfaces when compared to a non-treated surface, for example, in order to facilitate subsequent cleaning. It applies to hard surfaces, notably hard surfaces in domestic and industrial and/or institutional cleaning (often abbreviated to "I & I Cleaning").

Sarcosine is also known as N-methylglycine. For the avoidance of doubt, the chemical structure of sarcosine is as shown below.

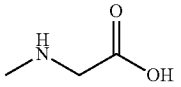

Sarcosine

Sarcosine may be obtained by synthesis from chloroacetic acid and methylamine, although sarcosine produced using any route may be used in the present invention.

Fatty acids will be understood as each comprising a carboxylic acid with a long unbranched aliphatic tail or chain.

The fatty acid for use with the sarcosine may be selected from either a saturated or unsaturated fatty acid, and from a linear or branched fatty acid. If unsaturated fatty acids are used, they may be selected from fatty acids having either a cis/trans configuration, and may have one or more than one unsaturated double bonds.

Preferably, the fatty acids used are saturated fatty acids. Preferably, the fatty acids used are linear fatty acids. More preferably, the fatty acids used are saturated linear fatty acids.

Suitable fatty acids may be selected from those containing in the range from a total of 8 to 26 carbon atoms. Preferably, the fatty acids each contain 10 to 22 carbon atoms. More preferably, 12 to 18 carbon atoms.

It will be understood that, when describing the number of carbon atoms, this refers to the total number of carbon atoms including the one at the carboxylic acid, and any present in any branch groups. The number of carbon atoms in the aliphatic chain itself will therefore be the total number of carbon atoms less one.

The fatty acids used with the sarcosine in the present invention are preferably derived from natural sources. As such, the fatty acids used may comprise a mixture of fatty acids of differing chain lengths.

As most naturally occurring fatty acids have a total number of carbon atoms of an even number, fatty acids with an even number of carbon atoms are preferred.

Suitable fatty acids may preferably be selected from caprylic acid, capric acid, lauric acid, myristic acid, palmitic acid, stearic acid, arachidic acid, behenic acid, lignoceric acid, or cerotic acid.

More preferably, the fatty acid may be selected from capric acid, lauric acid, myristic acid, palmitic acid, stearic acid, arachidic acid, or behenic acid. Further preferably, selected from lauric acid, myristic acid, palmitic acid, or stearic acid.

Most preferably, the fatty acid is myristic acid.

The fatty acids of sarcosines are prepared from addition of the fatty acids and sarcosine.

Suitable fatty acids of sarcosines may preferably be selected from capryloyl sarcosine, caproyl sarcosine, lauroyl sarcosine (also termed cocoyl sarcosine), myristoyl sarcosine, palmitoyl sarcosine, stearoyl sarcosine, arachidoyl sarcosine, behenoyl sarcosine, lignoceroyl acid, or cerotoyl acid.

Preferably, the fatty acids of sarcosines are selected from caproyl sarcosine, lauroyl sarcosine, myristoyl sarcosine, palmitoyl sarcosine, stearoyl sarcosine, arachidoyl sarcosine, or behenoyl sarcosine.

More preferably, the fatty acids of sarcosine are selected from lauroyl sarcosine, myristoyl sarcosine, palmitoyl sarcosine, or stearoyl sarcosine.

Most preferably, the fatty acid of sarcosine is myristoyl sarcosine.

In an alternative embodiment, salts of the fatty acids of sarcosines may be used in the cleaning composition. Suitable salts may be selected from sodium, potassium, or ammonium salts of any of the above detailed fatty acids of sarcosine.

Preferably, sodium salts of the fatty acids of sarcosines may be used.

Sodium salts of fatty acids of sarcosines may be selected from sodium capryloyl sarcosinate, sodium caproyl sarcosinate, sodium lauroyl sarcosinate (also termed sodium cocoyl sarcosinate), sodium myristoyl sarcosinate, sodium palmitoyl sarcosinate, sodium stearoyl sarcosinate, sodium arachidoyl sarcosinate, sodium behenoyl sarcosinate, sodium lignoceroyl sarcosinate, or sodium cerotoyl sarcosinate.

Preferably, the sodium salts of fatty acids of sarcosines are selected from sodium caproyl sarcosinate, sodium lauroyl sarcosinate, sodium myristoyl sarcosinate, sodium palmitoyl sarcosinate, sodium stearoyl sarcosinate, sodium arachidoyl sarcosinate, or sodium behenoyl sarcosinate.

More preferably, the sodium salts of fatty acids of sarcosine are selected from sodium lauroyl sarcosinate, sodium myristoyl sarcosinate, sodium palmitoyl sarcosinate, or sodium stearoyl sarcosinate.

Most preferably, the sodium salt of fatty acids of sarcosine may be sodium myristoyl sarcosinate.

It is envisaged that the fatty acid of a sarcosine or salts thereof as used in the cleaning composition may be homogeneous in that it comprised of only one specific fatty acid sarcosine selected from those listed above.

In the alternative embodiment, the fatty acid of a sarcosine or salts thereof as used in the cleaning composition may be a mixture comprised from two or more of those listed herein in any combination. Therefore, mixtures of sodium salts of fatty acids of sarcosines may be used. For example, a mixture of sodium lauroyl sarcosinate and sodium myristoyl sarcosinate may be used in the cleaning composition. In particular, where the fatty acids are derived from natural sources mixtures, the cleaning composition may be a mixture of more than one fatty acid of sarcosines.

The fatty acid of a sarcosine or salts thereof may be used in the form of a diluted solution comprising from 10 to 50 wt. % of the compound, preferably from 20 to 40 wt. %, with the remainder being comprised of water or other suitable solvent.

The amino acid component of the fatty acid of an amino acid as used in the present invention may be derived from a homogeneous amino acid source comprising one, or possibly two, amino acids.

In an alternative preferred embodiment, the amino acid may be derived from a natural protein source, and may comprise hydrolysed protein. In such an embodiment, the protein would be hydrolysed to form an amino acid mixture for use in the present invention.

The protein material which may be hydrolysed to form the amino acids may be derived from either animal or vegetable sources, or by fermentation. Proteins may be derived from collagen, elastin, keratin, casein, wheat protein, potato protein, soya protein, and/or silk protein. Preferably, the hydrolysed protein may be derived from wheat protein and/or collagen. More preferably, the hydrolysed protein may be derived from wheat protein.

Suitable amino acids for use in the fatty acid of an amino acid may therefore be selected from any proteinogenic amino acids which are found in wheat proteins.

The term "hydrolysed protein" as used herein comprises amino acids and/or peptides, since the latter can all be categorised as hydrolysed proteins. In particular, hydrolysed proteins comprising polypeptides and peptides, which may for example be produced by acid, alkali, and/or enzyme hydrolysis, of native proteins, are preferred. Acid hydrolysed proteins are preferred.

As a result of the acid hydrolysis, the amino acid starting material when derived from natural sources (e.g. hydrolysed wheat protein) may therefore contain some short chain peptides as well as the amino acid themselves.

Chemically modified hydrolysed proteins may also be employed, for example where the protein has been covalently reacted with a functional group, e.g. a silane, a quaternary ammonium compound and/or an acid chloride.

The molecular weight (weight average) of the amino acids may vary over a wide range, such as for example in the range from 50 to 5,000 Daltons.

In particular, the molecular weight (weight average) of the amino acids is suitably in the range from 75 to 1,000, preferably 85 to 250, more preferably 100 to 150 Daltons.

It should be noted that, where the hydrolysed protein is derived from a natural source protein, the amino acids obtained from the hydrolysed protein may comprise a mixture of different amino acids. As such, the fatty acid of an amino acid as used in the present invention may therefore comprise a mixture of amino acid fatty acids, where the presence and proportions of the amino acid mixture reflects the amino acids present in the hydrolysed protein.

The composition of the amino acids in the protein can also be an important parameter, and in one embodiment the protein comprises at least 20 wt. %, preferably in the range from 30 to 65 wt. %, more preferably 40 to 55 wt % of preferred amino acids. The preferred amino acids for the present invention are glutamic acid and/or proline. The remaining proportion of the amino acid mixture may therefore be made up of other amino acids.

Preferably, the amount of glutamic acid present in the protein, and therefore in the amino acid mixture, may be greater than 15 wt. %. More preferably, the amount of glutamic acid may be in the range from 25 to 50 wt. %. Most preferably, the amount of glutamic acid present may be in the range from 35 to 45 wt. %.

Preferably, the amount of proline present in the protein, and therefore in the amino acid mixture, may be greater than 8 wt. %. More preferably, the amount of proline may be in the range from 10 to 15 wt. %. Most preferably, the amount of proline present may be in the range from 11 to 13 wt. %.

The fatty acid for use with the amino acid may be selected from either a saturated or unsaturated fatty acid, and from a linear or branched fatty acid. If unsaturated fatty acids are used they may be selected from fatty acids having either a cis or trans configuration, and may have one or more unsaturated double bonds.

Preferably, the fatty acids used are saturated fatty acids. Preferably, the fatty acids used are linear fatty acids. More preferably, the fatty acids used are saturated linear fatty acids.

Suitable fatty acids may be selected from those containing in the range from a total of 10 to 18 carbon atoms. Preferably, the fatty acids each contain 10 to 16 carbon atoms. More preferably, 12 to 14 carbon atoms.

Suitable fatty acids may preferably be selected from capric acid, lauric acid, myristic acid, palmitic acid, stearic acid, or arachidic acid.

More preferably, the fatty acid may be selected from capric acid, lauric acid, myristic acid, palmitic acid, or stearic acid.

Most preferably, the fatty acid is lauric acid.

The fatty acids of the amino acids may be prepared by addition of the corresponding fatty acid chlorides to the amino acid or amino acid mixture.

The fatty acid of an amino acid component of the present invention may comprise a mixture of fatty acids of amino acids in which there is a mixture of fatty acids, amino acids, or both.

In one embodiment, the fatty acid of an amino acid as used in the present invention may comprise a plurality of amino acids derivable from wheat protein, which are bonded to a fatty acid, this being achieved by reaction with a fatty acid chloride.

Preferably salts of the fatty acids of the amino acids may be used in the cleaning composition. Suitable salts may be selected from sodium, potassium, triethanolamine (TEA), or ammonium salts of fatty acids of amino acids.

Preferably, potassium or triethanolamine (TEA) salts are used.

Salts of fatty acids of amino acids may preferably be selected from potassium lauroyl glutamate, sodium lauroyl glutamate, or TEA lauroyl glutamate.

It is envisaged that the salts of fatty acids of amino acids as used in the cleaning composition may be homogeneous in that it comprised of only one specific salts of fatty acid of an amino acid.

In the alternative embodiment, the salts of fatty acids of amino acids as used in the cleaning composition may be a mixture comprised from two or more of those listed herein in any combination. Therefore, mixtures of salts of fatty acids of amino acids may be used. For example, a mixture of potassium lauroyl glutamate and TEA lauroyl glutamate may be used in the cleaning composition.

The salts of fatty acids of amino acids may be used in the form of a diluted solution comprising from 10 to 50 wt. % of the compound, with the remainder being water or other suitable solvent.

The cleaning composition may comprise any combination of fatty acid of a sarcosine, and fatty acid of an amino acid, or salts thereof.

Preferably, the ratio of fatty acid of a sarcosine to fatty acid of an amino acid in the cleaning composition is in the range from 20:1 to 120:1. More preferably, the ratio is in the range from 50:1 to 80:1. Further preferably, the ratio is in the range 55:1 to 65:1. Most preferably, the ratio is 60:1.

The cleaning composition may comprise fatty acid of a sarcosine or salts thereof in the amount from 10 wt. % to 80 wt. %. Preferably, in the amount from 20 wt. % to 40 wt. %. Most preferably, in the amount from 25 wt % to 35 wt. %.

The cleaning composition may comprise fatty acid of an amino acid or salts thereof in the amount from 0.1 wt. % to 20 wt. %. Preferably, in the amount from 0.2 wt. % to 10 wt. %. Most preferably, in the amount from 0.5 wt. % to 2.0 wt. %.

Whilst the above ratios and amounts refer to the actual amount of each component in the cleaning composition, it is envisaged that the components may be added to the composition in the form of dilute solutions. Typically, the fatty acid of sarcosine may be added in the form of a 30 wt. % active solutions, whilst the fatty acid of an amino acid solution may be added in the form of a 25 wt % active solution. In both cases, the solution may use water or any other suitable solvent.

The resulting cleaning composition may be used for application to a hard surface.

In an alternative embodiment, the cleaning composition may be further diluted such that it comprises in the range from 0.2 wt. % to 10 wt. % of an end use cleaning formulation. Said dilution may be achieved either by addition of a solvent such as water, or by addition of the cleaning composition to an existing cleaning formulation in order to provide limescale repellency to said formulation.

Preferably, the cleaning formulation may comprise in the range from 0.6 wt. % to 5 wt. % of cleaning composition. Most preferably, in the range from 1.0 wt. % to 2.0 wt. %.

Thus, according to a third aspect of the present invention there is provided an end-use cleaning formulation, said formulation comprising in the range from 0.2 wt. % to 10 wt. % of the cleaning composition of the first aspect.

The cleaning composition is used for application to hard surfaces in order to improve both soil repellency and soil removal.

It has also been found that, where the cleaning composition or cleaning formulation is formulated such that it is an acidic solution, for example under pH 6.0 or less, the stability of the cleaning composition may be improved by addition of alkoxylated fatty alcohols.

The fatty alcohol of said alkolyated fatty alcohol represents hydrocarbon chain and a single alcohol group (—OH) attached to the terminal carbon. Said hydrocarbon chain may represent a $C_4$ to $C_{22}$ hydrocarbon, where the carbon number refers to the total number of carbon atoms present in the substituent group, including any present in any branched groups.

Preferably, the hydrocarbon chain is a $C_6$ to $C_{18}$ hydrocarbon. More preferably, a $C_8$ to $C_{16}$. Most preferably a $C_{10}$ to $C_{14}$ hydrocarbon.

The hydrocarbon chain may be saturated, or unsaturated. Preferably, the hydrocarbon chain is saturated.

The hydrocarbon chain may be straight chain, or branched. Preferably, the hydrocarbon chain is straight chain.

Suitable fatty alcohols may preferably comprise saturated linear fatty chains. Examples of suitable said fatty alcohols may comprise capryl alcohol ($C_8$), capric alcohol ($C_{10}$), lauryl alcohol ($C_{12}$), myristyl alcohol, palmityl alcohol ($C_{16}$), stearyl alcohol ($C_{18}$), arachidyl alcohol ($C_{20}$), behenyl alcohol ($C_{22}$).

The alkolyated fatty alcohol is preferably an ethoxylated fatty alcohol, propoxylated fatty alcohol, or an ethoxylated-propoxylated fatty alcohol. The number of alkylene oxide repeat units in the alkyoxlation moieties is preferably in the range from 1 to 18, more preferably from 3 to 16, most preferably in the range from 6 to 12.

Particularly preferred alkoxylated fatty alcohols may include ethoxylated octan-1-ol, ethoxylated propoxylated $C_{12-15}$ alcohols, and ethoxylated $C_{9-11}$ alcohols.

The end-use cleaning formulation may comprise in the range from 0.1 wt. % to 4.0 wt. % of alkoxylated fatty alcohol. More preferably, in the range from 0.2 wt. % to 2.0 wt. %. Most preferably, in the range from 0.25 wt. % to 1.5 wt. %.

Addition of alkoxylated fatty alcohols has been found to improve stability of the cleaning compositions, and in particular end-use cleaning formulations, especially under acidic conditions. This is particularly advantageous for bathroom cleaner formulations which typically comprise citric acid and have pH values less than 6.0. The use of alkoxylated fatty alcohols may be particularly preferred for high surfactant (e.g. alkyl polyglucoside) concentrations designed for removal of high grease stains.

It should be understood that by the term "soils" it is included limescale and related materials which would otherwise adhere to a hard surface or be difficult to remove therefrom.

Other soils may include soils made substantially of mineral deposits, such as alkali metal, particularly calcium and/or magnesium carbonates, and stains which include such mineral deposits combined with other soil such as water insoluble soap salts, such as calcium and/or magnesium stearates.

As applied to hard surfaces in accordance with the second aspect, the invention will typically comprise the following steps:

a) applying to a hard surface an aqueous cleaning composition in accordance with the first aspect of the present invention, typically by pouring or spraying the composition on the hard surface or by using an application means;
b) simultaneously or subsequently spreading and/or wiping the composition over the hard surface, usually with a fibrous or porous wiping or spreading means; and then
c) optionally removing or rinsing at least part of the liquid, from the hard surface with water and/or a fibrous or porous drying means, some dirt being removed from the hard surface in the rinse water and/or the drying means.

It has surprisingly been found that when the composition of the first aspect compound is present in cleaning formulations, it covers and adheres to hard surfaces being cleaned and modifies the surface giving, in particular, limescale repellency. This reduces limescale and other related unwanted material build-up on the surface to start with, and also makes it a lot easier to rinse off limescale from the surface.

All of the features described herein may be combined with any of the features of any of the above aspects, in any combination.

In order that the present invention may be more readily understood, reference will now be made, by way of example, to the following description.

It will be understood that all tests and physical properties listed have been determined at atmospheric pressure and room temperature (i.e. 20° C.), unless otherwise stated herein, or unless otherwise stated in any referenced test methods and procedures.

Protocol for Measurement of Limescale Repellency on Transparent Hard Surfaces

This protocol describes a method for the determination of limescale repellency on glass, polyacrylate, and polycarbonate substrates. It can be used to demonstrate the limescale repellency effect when adding various surface modifying products to a base formulation.

A 60 g test solution was prepared in a 100 ml, glass beaker by adding 0.1, 0.5 or 1.0 wt. % active of the test product into either demineralised water, or a shower clean mimic formulation comprising 1.0 wt. % Synperonic 91/5 (polyoxyethylene (5) $C_9$-$C_{11}$ alcohol available from Croda, UK) in demineralised water until fully dissolved.

A solution of 1,000 ppm $Ca(HCO_3)_2$ in water was prepared by addition of 1.47 g $CaCl_2.2H_2O$ and 1.68 g $NaHCO_3$ to a 1 liter volumetric flask. The required volume of demineralised water was added, and a cloudy solution was achieved.

The test slides (made from glass, polyacrylate, and polycarbonate) were marked to identify the sample being tested, and carefully placed end-on into the test solution such that typically half the slide was immersed. The slides were then left for a period of 1 hour to soak in the test solution.

The slides were then removed from the test solution, and any excess test solution was carefully shaken off. The slides were then placed in a petri-dish containing 50 ml of 1,000 ppm $Ca(HCO_3)_2$ solution, and left to soak overnight.

The slides were then carefully removed from the petri-dish and gently rinsed on both sides with demineralised water using a disposable pipette (1×2 ml on the reverse and 2×2 ml on the exposed side). The slides were then stood upright and allowed to dry.

Once the slides were fully dried they were placed in a spectrophotometer (Jenway 6300), such that the exposed side (i.e. the upper side in the petri-dish) was facing the light beam. Three readings were taken across the face of the slide with the spectrophotometer set to transmission mode at 403 nm with the spectrophotometer readings noted as % transmission (% T) values. Average percentage transmissions for each test slide were recorded.

Example Cleaning Composition

A cleaning composition comprising a mixture of sodium myristoyl sarcosinate solution (98 wt. % of solution) and potassium lauroyl amino acid (amino acids from hydrolysed wheat protein) solution (2 wt. % of solution) was tested for limescale repellency. For ease of reference this composition will be termed Composition A. This composition was made by weighing the individual components being mixed until a homogeneous mixture was achieved. The mixture was diluted in water, such that the diluted solution contained sodium myristoyl sarcosinate (30 wt. %) and potassium lauroyl amino acid (0.4 wt. %) solution in water.

The resulting composition was added to two commercially available shower cleaning formulations with timescale repellency tests conducted on glass, polyacrylate, and polycarbonate slides. The composition was added to the cleaning formulations at various concentrations of 0.1, 0.5, and 1.0 wt. %.

The two commercially available cleaning formulations were:

Mr Muscle Shower Clean (S C Johnson)

Morrisons Shower Clean (own brand)

Limescale repellency testing was carried out on each formulation using the following test protocol. Solutions of Mr Muscle Shower Clean and Morrisons Shower Clean products comprising 0.1, 0.5, and 1.0% wt. % active solutions of Composition A were prepared. Clean glass microscope slides, polyacrylate slides, and polycarbonate slides were immersed in the solutions for at least one hour.

The slides were removed, drained, and immediately immersed horizontally in a petri dish containing 50 ml of freshly prepared, cloudy, 1,000 ppm $Ca(HCO_3)_2$ solution, then left overnight.

The slides were then removed and rinsed by discharging a pipette containing demineralised water (ca. 2 ml) across both the front and back, and then the slide was left to dry.

The % T of each slide was measured in a spectrophotometer (Jenway 6300) set to 403 nm, and three measurements were taken across the slide surface in order to record an average value. All measurements were carried out in duplicate by repeating the tests using clean slides.

Test Results

The % T results obtained as noted above were then plotted on graphs which show the level of limescale repellency provided by Composition A. Results were also recorded and plotted for a cleaning product comprising no Composition A (i.e. 0 wt. % concentration as shown in the tables and on the graphs) as a comparison.

TABLE 1

| Mr Muscle Shower Shine & Composition A | | | |
|---|---|---|---|
| Concentration of | Substrate Surface | | |
| Composition A (wt. %) | Glass | Polyacrylate | Polycarbonate |
| 0 | 60.8 | 49.1 | 46.4 |
| 0.1 | 75.7 | 56.3 | 53.6 |
| 0.5 | 83.6 | 59.8 | 58.8 |
| 1.0 | 86.6 | 70.6 | 77.7 |

TABLE 2

| Morrisons Shower Shine & Composition A | | | |
|---|---|---|---|
| Concentration of | Substrate Surface | | |
| Composition A (wt. %) | Glass | Polyacrylate | Polycarbonate |
| 0 | 56.8 | 59.1 | 50.1 |
| 0.1 | 70.0 | 70.8 | 85.2 |
| 0.5 | 77.6 | 82.9 | 86.6 |
| 1.0 | 81.1 | 84.9 | 86.1 |

Figure 2:
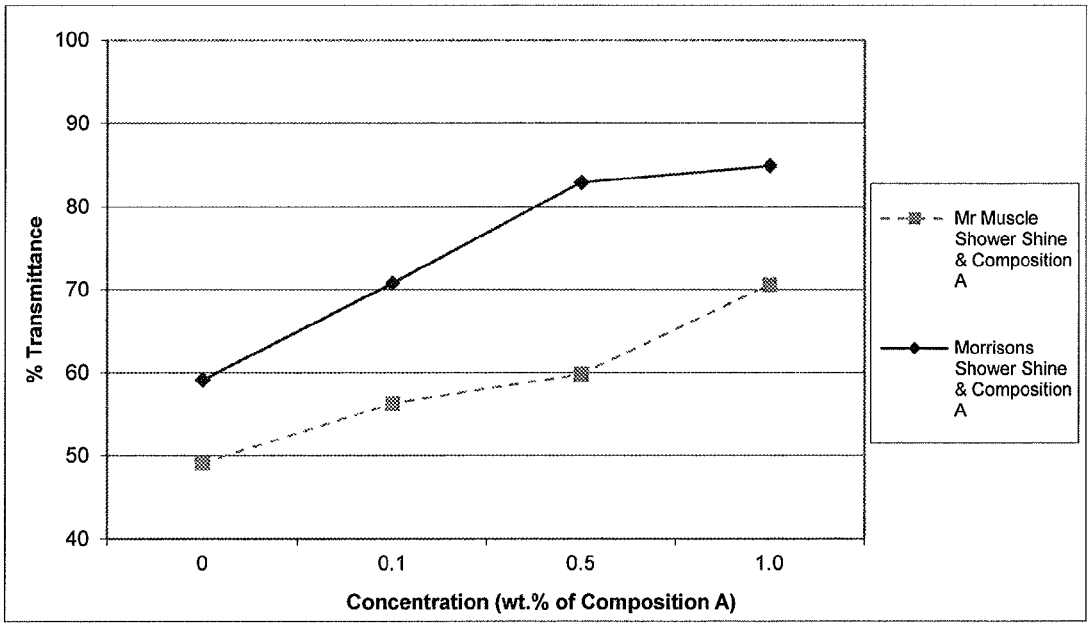
FIG. 2 shows a graph of the limescale repellency on polyacrylate slides.
Figure 3:
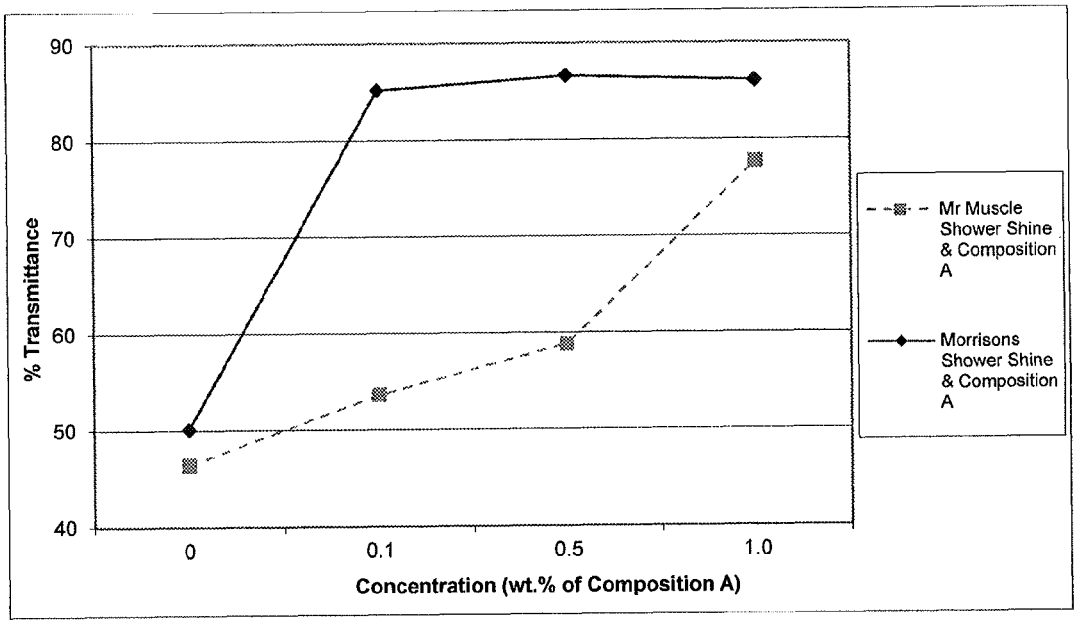
FIG. 3 shows a graph of the limescale repellency on polycarbonate slides.

Results from the testing are further shown in FIGS. 1 to 3. Comments regarding the limescale repellency results obtained are discussed with reference to FIGS. 1 to 3.

FIG. 1 shows a graph of the limescale repellency results on glass slides;

FIG. 2 shows a graph of the limescale repellency on polyacrylate slides; and FIG. 3 shows a graph of the limescale repellency on polycarbonate slides.

Referring to FIG. 1, there is shown a graph of % T values as measured on test slides made from glass and subjected to Composition A of 0.1 wt. %, 0.5 wt. % and 1.0 wt. % in the two commercially available shower cleaning products. In addition, a result was obtained with no Composition A present (0 wt. %) in order to act as a control.

The % T value of the control slide was found to be around 60%. Therefore, the desire was to achieve % T values which were higher than this, and which would demonstrate that less limescale had adhered to the slide as the transmittance to light of the slide had been improved. For example, a % T value of 100% would indicate that no limescale had adhered to the slide.

FIG. 1 clearly shows that improved transmittance was obtained when using Composition A for both shower cleaning products on glass slides. Addition of Composition A to either commercial shower cleaning formulations therefore gave a boost to the limescale repellency on glass surfaces.

Referring to FIG. 2, there is shown a graph of % T values as measured on test slides made from polyacrylate and subjected to Composition A of 0.1 wt. %, 0.5 wt. % and 1.0 wt. % in the two commercially available shower cleaning products. In addition, a result was obtained with no Composition A present (0 wt. %) in order to act as a control.

The % T value of the control slide was found to be around 50%. The same explanation for % T values as discussed with reference to FIG. 1 also applies to FIG. 2.

FIG. 2 clearly shows that improved transmittance was obtained when using Composition A for both shower cleaning products on polyacrylate slides. Addition of Composition A to either commercial shower cleaning formulations therefore gave a boost to the limescale repellency on polyacrylate surfaces.

Referring to FIG. 3, there is shown a graph of % T values as measured on test slides made from polycarbonate and subjected to Composition A of 0.1 wt. %, 0.5 wt. % and 1.0 wt. % in the two commercially available shower cleaning products. In addition, a result was obtained with no Composition A present (0 wt %) in order to act as a control.

The % T value of the control slide was found to be around 50%. The same explanation of % T values as discussed with reference to FIG. 1 also applies to FIG. 3.

FIG. 3 clearly shows that improved transmittance was obtained when using Composition A for both shower cleaning products on polycarbonate slides. Addition of Composition A to either commercial shower cleaning formulations therefore gave a boost to the limescale repellency on polycarbonate surfaces.

It can clearly be seen from FIGS. 1-3 that addition of Composition A to commercial shower cleaning formulations provides a significant boost to the limescale repellency on a variety of surfaces, in particular glass, polycarbonate, and polyacrylate surfaces. This advantageous effect of increased limescale repellency was observed on all three types of surfaces even at low concentrations of 0.1 wt. %.

After conducting further rinse-off testing using Composition A, it was also observed that some limescale repellency effect continues to remain even after the slide in subjected to 3 or 4 rinses.

Examples of Cleaning Composition Under Acidic Conditions

A number of example en-use cleaning formulations were made up under acidic conditions to show improved stability when adding an alkoxylated fatty alcohol.

Example 1

Limescale Cleaner

The decyl polyglucoside, sodium myristoyl sarcosinate and potassium lauroyl amino acid, and alkoxylated alcohol were added to the water with stirring until homogeneous. Citric acid was slowly added and left to mix until homogeneous. Benzisothiazolinone was then added as a preservative.

TABLE 3

Limescale Cleaner Formulation

| Product | Functionality | Concentration (wt. %) |
|---|---|---|
| Decyl glucoside | Surfactant | 2.8 |
| Sodium myristoyl sarcosinate (30 wt. %) & potassium lauroyl amino acid (0.4 wt. %) | Performance additive | 1.5 |
| Alkoxylated alcohol | Surfactant | 1.0 |
| Benzisothiazolinone | Preservative | 0.03 |
| Citric acid (40% solution) | Solvent | 10.0 |
| Water | Diluent/Solvent | 84.7 |

The formulation was used to remove limescale deposits in a bathroom. Limescale build up after application was reduced, and reduced spotting is observed on surfaces.

Example 2

Limescale Remover

The decyl polyglucoside, sodium myristoyl sarcosinate and potassium lauroyl amino acid, and alkoxylated alcohol were added to the water with stirring until homogeneous. Citric acid solution (40 wt. %) was slowly added to adjust the pH to 2.0. Benzisothiazolinone was then added as a preservative.

TABLE 4

Limescale Remover Formulation

| Product | Functionality | Concentration (wt. %) |
|---|---|---|
| Decyl glucoside | Surfactant | 3.2 |
| Sodium myristoyl sarcosinate (30 wt. %) & potassium lauroyl amino acid (0.4 wt. %) | Performance additive | 1.0 |

TABLE 4-continued

Limescale Remover Formulation

| Product | Functionality | Concentration (wt. %) |
|---|---|---|
| Alkoxylated alcohol | Surfactant | 0.5 |
| Benzisothiazolinone | Preservative | 0.03 |
| Citric acid (40% solution) | Solvent | to pH 2.0 |
| Water | Diluent/Solvent | 95.3 |

This formulation was used as a spray-on, leave, and then wipe off formulation for removing limescale deposits on kitchen surfaces. Limescale build up after application was reduced, and reduced spotting is observed on surfaces, especially on metal surfaces making the treated areas look cleaner for longer.

Example 3

Bathroom Cleaner

The decyl polyglucoside, sodium myristoyl sarcosinate & potassium lauroyl amino acid, propylene glycol-n-butyl ether, sodium citrate, and alkoxylated alcohol were added to the water with stirring until homogeneous. Citric acid solution (40 wt. %) was slowly added to adjust the pH to 3.5. Benzisothiazolinone was then added as a preservative.

TABLE 5

Bathroom Cleaner Formulation

| Product | Functionality | Concentration (wt. %) |
|---|---|---|
| Decyl glucoside | Surfactant | 2.4 |
| Sodium myristoyl sarcosinate (30 wt. %) & potassium lauroyl amino acid (0.4 wt. %) | Performance additive | 1.0 |
| alkoxylated alcohol | Surfactant | 0.25 |
| Propylene glycol n-butyl ether | Solvent | 1.0 |
| Benzisothiazolinone | Preservative | 0.03 |
| Citric acid (40% solution) | Solvent | to pH 3.5 |
| Sodium citrate | Complexing agent | 1.5 |
| Water | Diluent/solvent | 93.8 |

This formulation used as a daily bathroom cleaner which removes limescale deposits. Additionally, the high surfactant concentration provides a good cleaning action on the surfaces to which it is applied. Limescale build up after application was reduced, and reduced spotting is observed on surfaces, especially on metal surfaces making the treated areas look cleaner for longer.

For examples 1, 2, and 3, stable formulations were observed using the alkoxylated fatty alcohols. Additionally, use of alkoxylated fatty alcohols did not provide any detrimental impact on the improved soil resistance otherwise resulting from the cleaning formulation.

It is to be understood that the invention is not to be limited to the details of the above embodiments, which are described by way of example only. Many variations are possible.

The invention claimed is:

1. A method of treating a hard surface comprising applying to the surface a cleaning composition comprising at least one fatty acid of a sarcosine, and at least one fatty acid of an amino acid, and/or salts thereof.

2. The method according to claim 1, wherein the fatty acid of a sarcosine is selected from capryloyl sarcosine, caproyl sarcosine, lauroyl sarcosine, myristoyl sarcosine, palmitoyl sarcosine, stearoyl sarcosine, arachidoyl sarcosine, behenoyl sarcosine, lignoceroyl acid, or cerotoyl acid.

3. The method according to claim 2, wherein the fatty acid of a sarcosine is selected from lauroyl sarcosine, myristoyl sarcosine, palmitoyl sarcosine, or stearoyl sarcosine.

4. The method according to claim 3, wherein the fatty acid of a sarcosine is myristoyl sarcosine.

5. The method according to claim 1, wherein the fatty acid of a sarcosine is in the form of a sodium, potassium, or ammonium salt.

6. The method according to claim 5, wherein the salt is selected from sodium lauroyl sarcosinate, sodium myristoyl sarcosinate, sodium palmitoyl sarcosinate, or sodium stearoyl sarcosinate.

7. The method according to claim 6, wherein the salt is sodium myristoyl sarcosinate.

8. The method according to claim 1, wherein fatty acid of an amino acid is prepared by addition of a corresponding fatty acid chloride to an amino acid or amino acid mixture.

9. The method according to claim 1, wherein the amino acid is comprised from hydrolysed protein derived from a natural protein source.

10. The method according to claim 9, wherein the hydrolysed protein is derived from collagen, elastin, keratin, casein, wheat protein, potato protein, soya protein, and/or silk protein.

11. The method according to claim 10, wherein the hydrolysed protein is derived from wheat protein.

12. The method according to claim 1, wherein the fatty acid for use with the amino acid is selected from fatty acids having 10 to 18 carbon atoms.

13. The method according to claim 12, wherein the fatty acid is selected from capric acid, lauric acid, myristic acid, palmitic acid, or stearic acid.

14. The method according to claim 13, wherein the fatty acid is lauric acid.

15. The method according to claim 1, wherein the fatty acid of the amino acid is in the form of a sodium, potassium, triethanolamine (TEA), or ammonium salt.

16. The method according to claim 15, wherein the salt is selected from potassium lauroyl glutamate, sodium lauroyl glutamate, or TEA lauroyl glutamate.

17. The method according to claim 1, wherein the cleaning composition comprises fatty acid of a sarcosine or salts thereof in the amount from 20 wt. % to 40 wt. %.

18. The method according to claim 1, wherein the cleaning composition comprises fatty acid of an amino acid or salts thereof in the amount from 0.2 wt. % to 10 wt. %.

19. The method according to claim 1, wherein the cleaning composition is suitable for use in providing soil resistance to a hard surface.

20. A method of treating a hard surface comprising applying to the surface a cleaning formulation comprising in the range from 0.2 wt. % to 10 wt. % of a cleaning composition, wherein the cleaning composition comprises at least one fatty acid of a sarcosine, and at least one fatty acid of an amino acid, and/or salts thereof.

21. The method according to claim 20, wherein the pH of said formulation is less than 6.0, and the formulation comprises at least one alkoxylated fatty alcohol.

22. The method according to claim 21, wherein the alkolyated fatty alcohol is an ethoxyalted fatty alcohol, propoxylated fatty alcohol, or an ethoxylated-propoxylated fatty alcohol.

23. The method according to claim 21, wherein said formulation comprises in the range from 0.1 wt. % to 4.0 wt. % of alkoxylated fatty alcohol.

* * * * *